US005384975A

United States Patent [19]

Yuran

[11] Patent Number: 5,384,975

[45] Date of Patent: Jan. 31, 1995

[54] OVERHEAD DOOR APPARATUS

[76] Inventor: Joseph J. Yuran, 300 W. Park St., Hermitage, Pa. 16148

[21] Appl. No.: 220,194

[22] Filed: Mar. 30, 1994

[51] Int. Cl.[6] ..... E05D 15/40

[52] U.S. Cl. ..... 49/203; 49/246

[58] Field of Search ..... 49/203, 205, 197, 246, 49/253, 260, 261

[56] References Cited

U.S. PATENT DOCUMENTS

| | | | |
|---|---|---|---|
| 2,167,569 | 7/1939 | Graves et al. | 49/203 X |
| 2,228,314 | 1/1941 | Holmes | 49/203 |
| 2,233,638 | 3/1941 | Peck | 49/203 X |
| 3,464,161 | 9/1969 | Jonsson | 49/203 X |
| 3,596,403 | 8/1971 | Carr . | |
| 3,934,635 | 1/1976 | Kin . | |
| 3,950,894 | 4/1976 | DiMaio . | |
| 4,057,170 | 11/1977 | Dougherty . | |
| 5,016,393 | 5/1991 | Weinerman . | |

FOREIGN PATENT DOCUMENTS

| | | | |
|---|---|---|---|
| 1452078 | 8/1966 | France | 49/203 |
| 6618417 | 7/1967 | Netherlands | 49/203 |
| 432286 | 9/1967 | Switzerland | 49/203 |
| 428735 | 5/1935 | United Kingdom | 49/205 |

*Primary Examiner*—Peter M. Cuomo
*Assistant Examiner*—Jerry Redman

[57] ABSTRACT

A new and improved overhead door apparatus is provided for a structure, such as an enclosed trailer or enclosed truck body, and includes a pair of guide channel assemblies connected to a pair of sidewalls of the structure a predetermined distance from the floor of the structure. A pair of central pivot assemblies are connected to the pair of sidewalls. The central pivot assemblies are located on the pair of sidewalls at locations between the pair of guide channel assemblies and the floor. A rigid unitary door panel assembly which contains an interior X-frame assembly includes a pair of top corners, a pair of bottom corners, and a pair of sides separating the pair of top corners from the pair of bottom corners. The pair of top corners of the door panel assembly includes a pair of roller assemblies adapted to roll along the pair of guide channel assemblies. A pair of first extensible and retractable assemblies are pivotally connected between the pair of top corners of the door panel assembly and the pair of central pivot assemblies. A pair of second extensible and retractable assemblies are pivotally connected between the pair of bottom corners of the door panel assembly and the pair of central pivot assemblies. One of the pair of door panel sides, one of the pair of first extensible and retractable assemblies, and one of the pair of second extensible and retractable assemblies form three sides of a triangular structure.

12 Claims, 4 Drawing Sheets

FIG 6
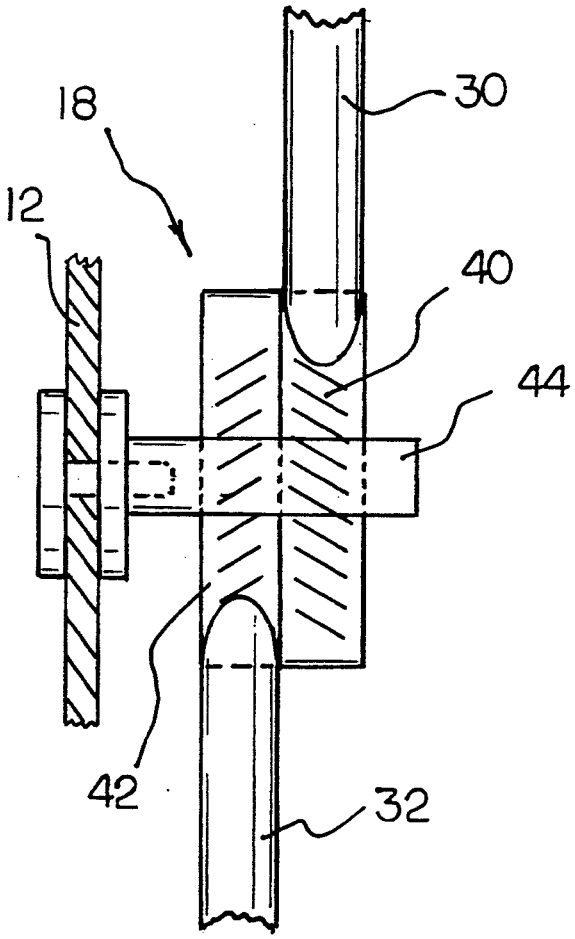
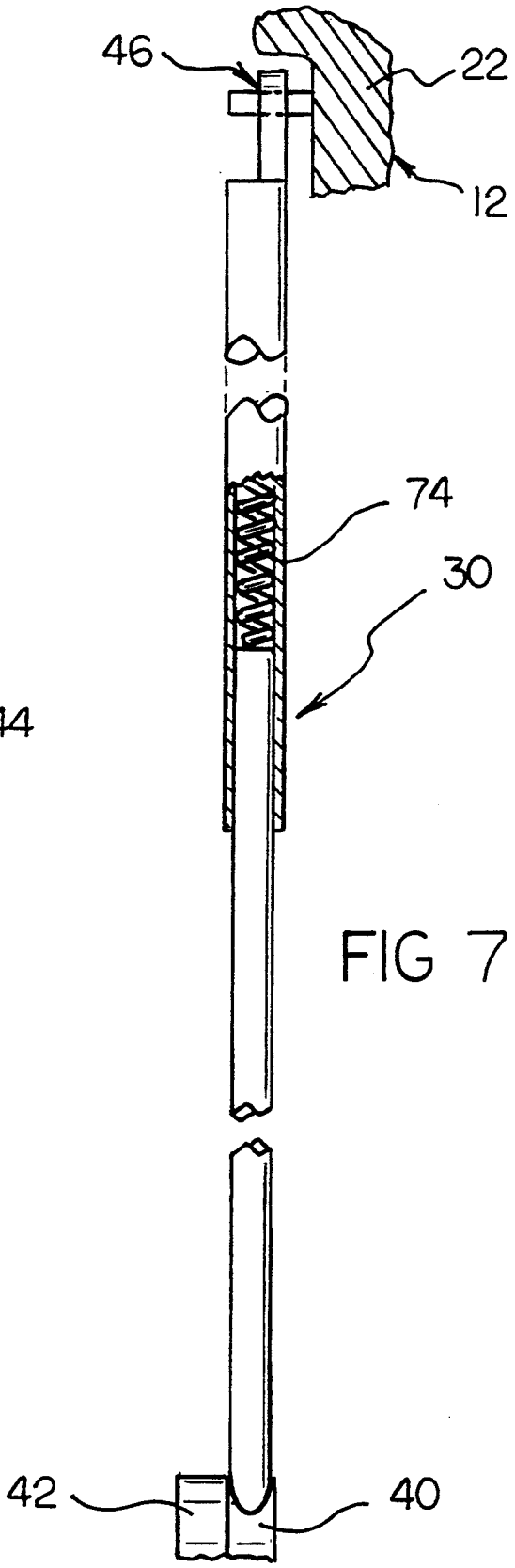
FIG 7

OVERHEAD DOOR APPARATUS

BACKGROUND OF THE INVENTION

1. Field of the Invention

The present invention relates generally to doors installed on enclosed trucks or trailer and, more particularly, to truck and trailer doors that are adapted for opening by being moved to a position above the door threshold.

2. Description of the Prior Art

Doors for enclosed trucks, and especially enclosed trailer doors, are often doors that are adapted for opening by being moved to a position above the door threshold. Such overhead doors are generally comprised of a plurality of articulated panel units that have laterally located rollers that ride in laterally located channels as the overhead door is opened and closed. The panels are connected to each other by hinges. Each channel has a vertical portion for keeping the articulated panels in a vertical orientation when the door is closed. Also, each channel has a horizontal portion for retaining the articulated panels in a horizontal orientation when the door is open. Unfortunately, with this type of overhead door, rollers and hinges for the articulated panels are highly susceptible to wear and tear and often need repair or replacement. In this respect, it would be desirable if an overhead door were provided for an enclosed truck or trailer that does not include a plurality of articulated panels connected together by hinges. Also, it would be desirable if an overhead door were provided for an enclosed truck or tr28 ailer which does not include a plurality of rollers associated with each of a plurality of articulated door panels.

The most important factors causing the wear and tear of the hinges of the articulated door panels and the lateral rollers are the vibrations and the road shocks that are transmitted to the stack of door panels and the rollers for each door panel when they are in the vertical portions of the lateral roller channels when the truck or trailer is in motion. Much of such vibration and road shock damage to the overhead door could be reduced or eliminated if the vertical stack of hinged door panels and the vertical stack of lateral rollers could be eliminated. In this respect, it would be desirable if an overhead door were provided for an enclosed truck or trailer that did not include a vertical stack of hinged door panels and did not include a vertical stack of lateral rollers.

In structures that bear stresses and strains, it is well known that the triangle is an excellent structural form for withstanding stresses and strains. In this respect, it would be desirable if an overhead door were provided for an enclosed truck or trailer that employed triangular construction forms.

Another contributing factor to damage experienced by an overhead door for a truck or trailer is the weight of the overhead door. A heavy overhead door tends to experience considerable vibration and road shock damage due to large inertial forces engendered by the heavy weight of the door. To lessen damage of vibration and road shock to an overhead door, it would be desirable if the overhead door were lightweight.

Lifting an overhead door for a truck or trailer may require considerable effort. The door must be lifted against the pull of gravity. To lessen the lifting effort, it would be desirable if the overhead door contained components which provide a lifting force to assist a person in lifting the overhead door.

Throughout the years, a number of innovations have been developed relating to doors for containers, such as tracks and trailers, and the following U.S. patents are representative of some of those innovations: U.S. Pat. Nos. 3,596,403; 3,934,635; 3,950,894; 4,057,170; and 5,016,393. More specifically, U.S. Pat. Nos. 3,596,403 and 4,057,170 disclose trailer doors that open sideways, not overhead. Such side opening doors require two doors at the back of each trailer, one door for the left side and one door for the right side. To avoid the complexity of two doors, it would be desirable if only one truck or trailer door were employed.

U.S. Pat. No. 3,934,635 discloses an overhead door for a trailer that employs a plurality of hinged door panels that have laterally disposed rollers as described above. In addition, the panels are counterbalanced by a spring which is wound by gears that cooperate with racks on the horizontal portions of the tracks on which the panels are movably supported. Although the use of a counterbalancing device is desirable, the use of gears which cooperate with racks may not be. Rotating gears present structures that need be periodically lubricated and may be prone to squeaking if not properly lubricated. In this respect, it would be desirable if an overhead door were provided for an enclosed truck or trailer which provided counterbalancing without the use of gears.

U.S. Pat. Nos. 3,950,894 and 5,016,393 may be of interest for their disclosure of particular door constructions. However, none of the doors disclosed in these patents are for overhead doors for trucks or trailers.

Thus, while the foregoing body of prior art indicates it to be well known to use overhead doors for trucks and trailers, the prior art described above does not teach or suggest a overhead door apparatus which has the following combination of desirable features: (1) does not include a plurality of articulated panels connected together by hinges; (2) does not include a plurality of rollers associated with each of a plurality of articulated door panels; (3) does not include a vertical stack of hinged door panels and does not include a vertical stack of lateral rollers; (4) employs triangular construction forms; (5) is lightweight; (6) contains components which provide a lifting force to assist a person in lifting the overhead door; (7) employs only one door panel; and (8) provides counterbalancing of a single door panel without the use of gears. The foregoing desired characteristics are provided by the unique overhead door apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved overhead door apparatus for a structure, such as an enclosed trailer or enclosed truck body, which has a pair of sidewalls spaced from each other by a predetermined distance and which has a floor located between the pair of sidewalls. The overhead door apparatus includes a pair of guide channel assemblies connected to the pair of sidewalls of the structure a predetermined distance from the floor of the structure. A pair of central pivot assemblies is connected to the pair of sidewalls of the structure. The central pivot assemblies are located on the pair of sidewalls at locations between the pair of guide channel assemblies and the floor of the structure.

A rigid unitary door panel assembly includes a pair of top corners, a pair of bottom corners, and a pair of sides separating the pair of top corners from the pair of bottom corners. The pair of top corners of the door panel assembly includes a pair of roller assemblies adapted to roll along the pair of guide channel assemblies. A pair of first extensible and retractable assemblies is connected between the pair of top corners of the door panel assembly and the pair of central pivot assemblies. A pair of first pivot assemblies is provided for pivotally connecting the pair of first extensible and retractable assemblies to the pair of top corners of the door panel assembly. A pair of second extensible and retractable assemblies is connected between the pair of bottom corners of the door panel assembly and the pair of central pivot assemblies. A pair of second pivot assemblies is provided for pivotally connecting the pair of second extensible and retractable assemblies to the pair of bottom corners of the door panel assembly.

A side of the pair of door panel sides, a first extensible and retractable assembly of the pair of first extensible and retractable assemblies, and a second extensible and retractable assembly of the pair of second extensible and retractable assemblies form three sides of a triangular structure. A first pivot assembly of the pair of first pivot assemblies, a second pivot assembly of the pair of second pivot assemblies, and a central pivot assembly of the pair of central pivot assemblies form apexes of the triangular structure.

The first extensible and retractable assemblies include first hydraulic cylinder assemblies. The second extensible and retractable assemblies include second hydraulic cylinder assemblies. The central pivot assemblies include a first pivot wheel and a second pivot wheel supported by a common pivot axle. An end of one of the first extensible and retractable assemblies is connected to the first pivot wheel, and an end of one of the second extensible and retractable assemblies is connected to the second pivot wheel. The first extensible and retractable assemblies and the second extensible and retractable assemblies include internal springs.

The guide channel assemblies are connected to the two sidewalls near top portions of the sidewalls. The central pivot assemblies are located on the two sidewalls at locations mid-way between the guide channel assemblies and the floor of the structure.

The door panel assembly includes a frame assembly which includes a four-sided and four-corned peripheral frame portion and a four-legged, X-shaped interior frame portion which has four end portions which connect with corner portions of the four-corned frame portion. A triangle is formed by each peripheral side of the peripheral frame portion and two legs of the interior frame portion.

A cover is provided for covering the frame assembly. The frame assembly is made of aluminum, and the cover is made of fiberglass. A pair of transverse frame members is connected between a pair of peripheral sides and an X-portion of the interior frame portion. The transverse frame members perpendicularly bisect the pair of the peripheral sides. The door panel assembly further includes a lock assembly for locking the door panel assembly in a closed position.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved overhead door apparatus which has all of the advantages of the prior art and none of the disadvantages.

It is another object of the present invention to provide a new and improved overhead door apparatus which may be easily and efficiently manufactured and marketed.

It is a further object of the present invention to provide a new and improved overhead door apparatus which is of durable and reliable construction.

An even further object of the present invention is to provide a new and improved overhead door apparatus which is susceptible of a low cost of manufacture with regard to both materials and labor, and which accordingly is then susceptible of low prices of sale to the consuming public, thereby making such overhead door apparatus available to the buying public.

Still yet a further object of the present invention is to provide a new and improved overhead door apparatus which does not include a plurality of articulated panels connected together by hinges.

Still another object of the present invention is to provide a new and improved overhead door apparatus that does not include a plurality of rollers associated with each of a plurality of articulated door panels.

Yet another object of the present invention is to provide a new and improved overhead door apparatus which does not include a vertical stack of hinged door panels and does not include a vertical stack of lateral rollers.

Even another object of the present invention is to provide a new and improved overhead door apparatus that employs triangular construction forms.

Still a further object of the present invention is to provide a new and improved overhead door apparatus which is lightweight.

Yet another object of the present invention is to provide a new and improved overhead door apparatus that contains components which provide a lifting force to assist a person in lifting the overhead door.

Still another object of the present invention is to provide a new and improved overhead door apparatus which employs only one door panel.

Yet another object of the present invention is to provide a new and improved overhead door apparatus that provides counterbalancing of a single door panel without the use of gears.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 6 is an enlarged view of a portion of the embodiment of the invention shown in FIG. 2 taken along line 6—6 in FIG. 2.

FIG. 7 is a partially broken away view of a variable length support assembly for the embodiment of the invention shown in FIG. 2.

DESCRIPTION OF THE PREFERRED EMBODIMENT

Figure 1:
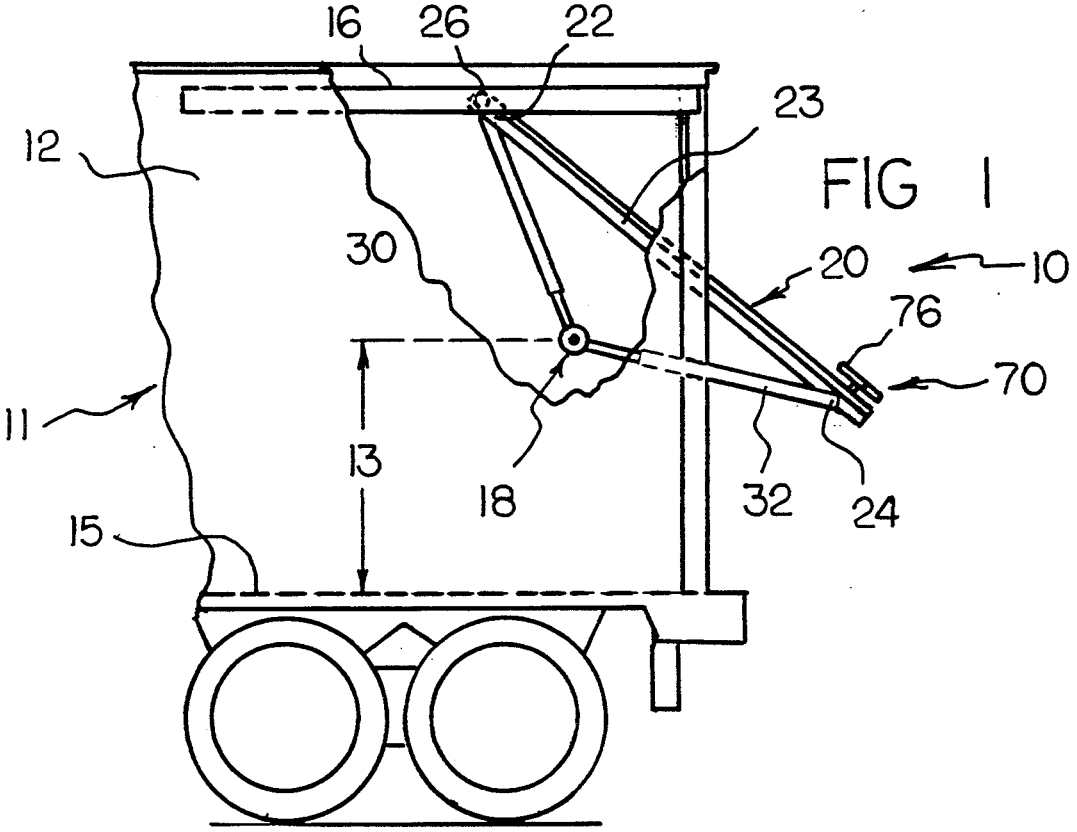
FIG. 1 partially broken away side view showing a preferred embodiment of the overhead door apparatus of the invention installed on a trailer, wherein the overhead door apparatus is half opened.
Figure 2:
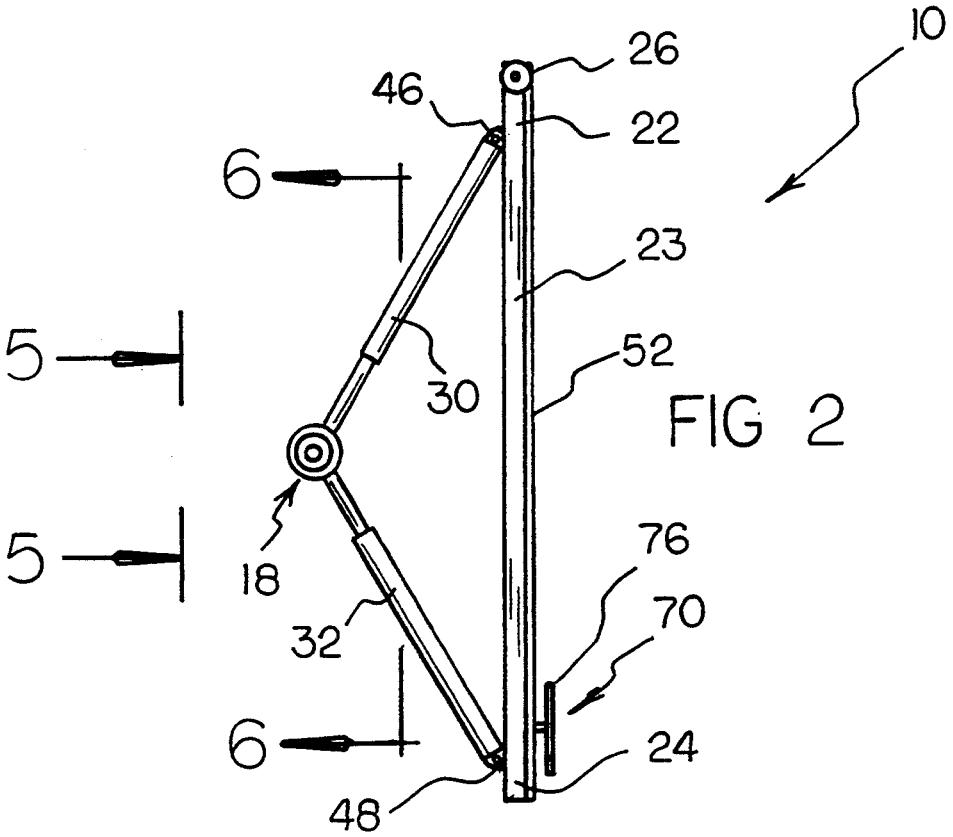
FIG. 2 is an enlarged side view of the embodiment of the invention shown in FIG. 1 which is removed from the trailer.

With reference to the drawings, a new and improved overhead door apparatus embodying the principles and concepts of the present invention will be described.

Turning to FIGS. 1–7, there is shown an exemplary embodiment of the overhead door apparatus of the invention generally designated by reference numeral 10. In its preferred form, overhead door apparatus 10 is provided for a structure 11 which has a pair of sidewalls 12 spaced from each other by a predetermined distance 14 and which has a floor 15 located between the pair of sidewalls 12. The overhead door apparatus 10 includes a pair of guide channel assemblies 16 connected to the pair of sidewalls 12 of the structure 11 a predetermined distance 13 from the floor 15 of the structure 11. A pair of central pivot assemblies 18 is connected to the pair of sidewalls 12 of the structure 11. The central pivot assemblies 18 are located on the pair of sidewalls 12 at locations between the pair of guide channel assemblies 16 and the floor 15 of the structure 11. The central pivot assemblies 18 can include ball bearings or roller bearings.

A rigid unitary door panel assembly 20 includes a pair of top corners 22, a pair of bottom corners 24, and a pair of sides 23 separating the pair of top corners 22 from the pair of bottom corners 24. The pair of top corners 22 of the door panel assembly 20 includes a pair of roller assemblies 26 adapted to roll along the pair of guide channel assemblies 16. A pair of first extensible and retractable assemblies 30 is connected between the pair of top corners 22 of the door panel assembly 20 and the pair of central pivot assemblies 18. A pair of first pivot assemblies 46 is provided for pivotally connecting the pair of first extensible and retractable assemblies 30 to the pair of top corners 22 of the door panel assembly 20. A pair of second extensible and retractable assemblies 32 is connected between the pair of bottom corners 24 of the door panel assembly 20 and the pair of central pivot assemblies 18. A pair of second pivot assemblies 48 is provided for pivotally connecting the pair of second extensible and retractable assemblies 32 to the pair of bottom corners 24 of the door panel assembly 20.

A side of the pair of door panel sides 23, a first extensible and retractable assembly 30 of the pair of first extensible and retractable assemblies 30, and a second extensible and retractable assembly 32 of the pair of second extensible and retractable assemblies 32 form three sides of a triangular structure. A first pivot assembly 46 of the pair of first pivot assemblies 46, a second pivot assembly 48 of the pair of second pivot assemblies 48, and a central pivot assembly 18 of the pair of central pivot assemblies 18 form apexes of the triangular structure.

The first extensible and retractable assemblies 30 include first hydraulic cylinder assemblies 30. The second extensible and retractable assemblies 32 include second hydraulic cylinder assemblies 32. As shown in greatest detail in FIG. 6, the central pivot assemblies 18 include a first pivot wheel 40 and a second pivot wheel 42 supported by common pivot axles 44. An end of one of the first extensible and retractable assemblies 30 is connected to the first pivot wheel 40, and an end of one of the second extensible and retractable assemblies 32 is connected to the second pivot wheel 42.

As shown in FIG. 7, the first extensible and retractable assemblies 30 and the second extensible and retractable assemblies 32 include internal springs 74. The internal springs 74 in the first extensible and retractable assemblies 30 and the second extensible and retractable assemblies 32 serve to counterbalance the weight of the door panel assembly 20.

Alternatively, the first extensible and retractable assemblies 30 and the second extensible and retractable assemblies 32 can be in the form of continuous springs or elastic belts connected between the top corners 22 and the bottom corners 24 of the door panel assembly 20 and pivoting around central pivot assemblies 18 which may be in the form of single pivot wheels on single pivot axles.

The guide channel assemblies 16 are connected to the two sidewalls 12 near top portions of the sidewalls 12. The central pivot assemblies 18 are located on the two sidewalls 12 at locations mid-way between the guide channel assemblies 16 and the floor 15 of the structure 11. The structure which has the two sidewalls 12 is a trailer. Also, the structure which has the two sidewalls 12 may be a truck.

Figure 5:
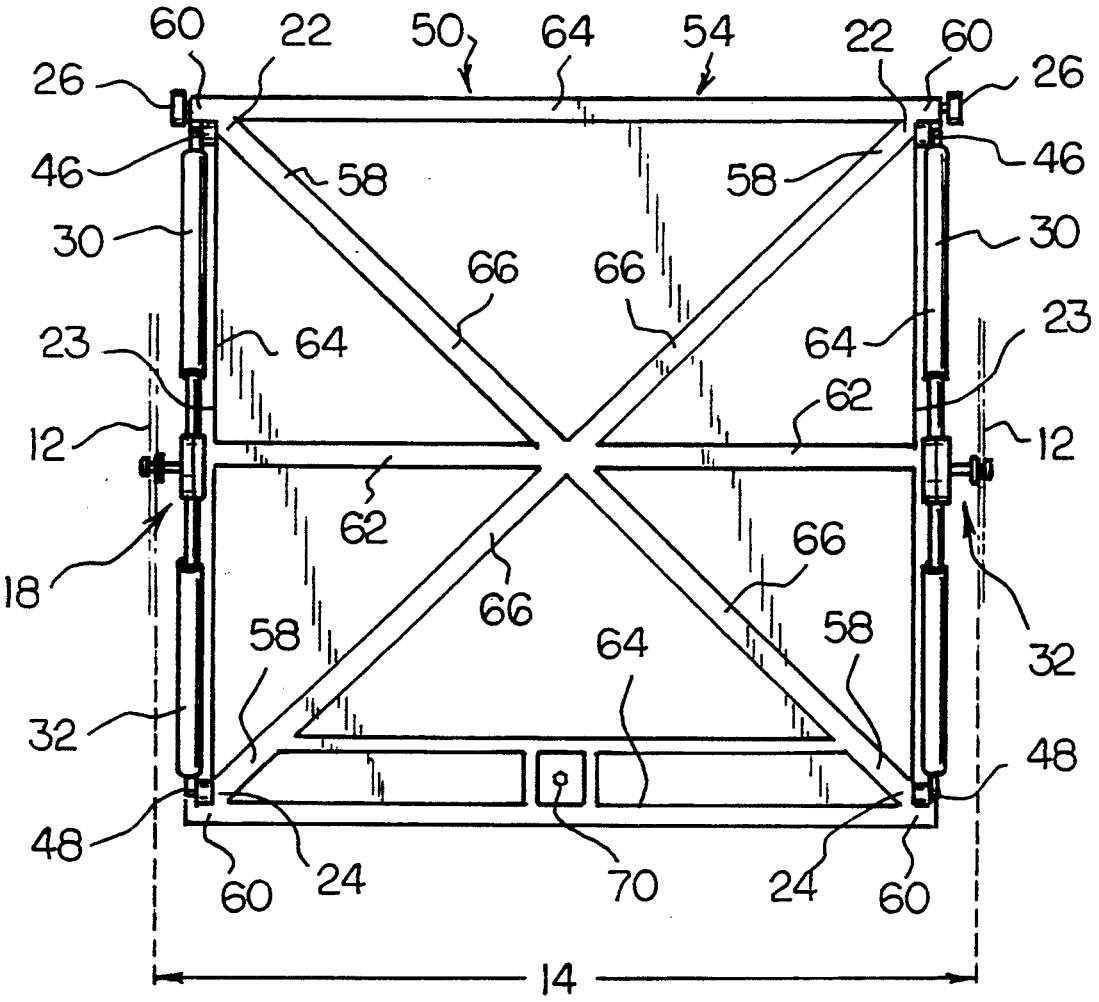
FIG. 5 is a rear view of the embodiment of the invention shown in FIG. 2 taken along line 5—5 of FIG. 2.

As shown in greatest detail in FIG. 5, the door panel assembly 20 includes a frame assembly 50 which includes a four-sided and four-corned peripheral frame portion 54 and a four-legged, X-shaped interior frame portion 56 which has four end portions 58 which connect with corner portions 60 of the four-corned frame portion 54. A triangle is formed by each peripheral side 64 of the peripheral frame portion 54 and two legs 66 of the interior frame portion 56.

A cover 52 is provided for covering the frame assembly 50. The frame assembly 50 is made of aluminum, and the cover 52 is made of fiberglass. The aluminum frame assembly 50 and the fiberglass cover 52 serve to provide a strong, lightweight door panel assembly 20. Alternatively, hollow steel tubing can be used for fabrication of the frame assembly 50.

A pair of transverse frame members 62 is connected between a pair of peripheral sides 64 and an X-portion 68 of the interior frame portion 56. The transverse frame members 62 perpendicularly bisect the pair of the peripheral sides 64.

The door panel assembly 20 further includes a lock assembly 70 for locking the door panel assembly 20 in a closed position.

Figure 3:
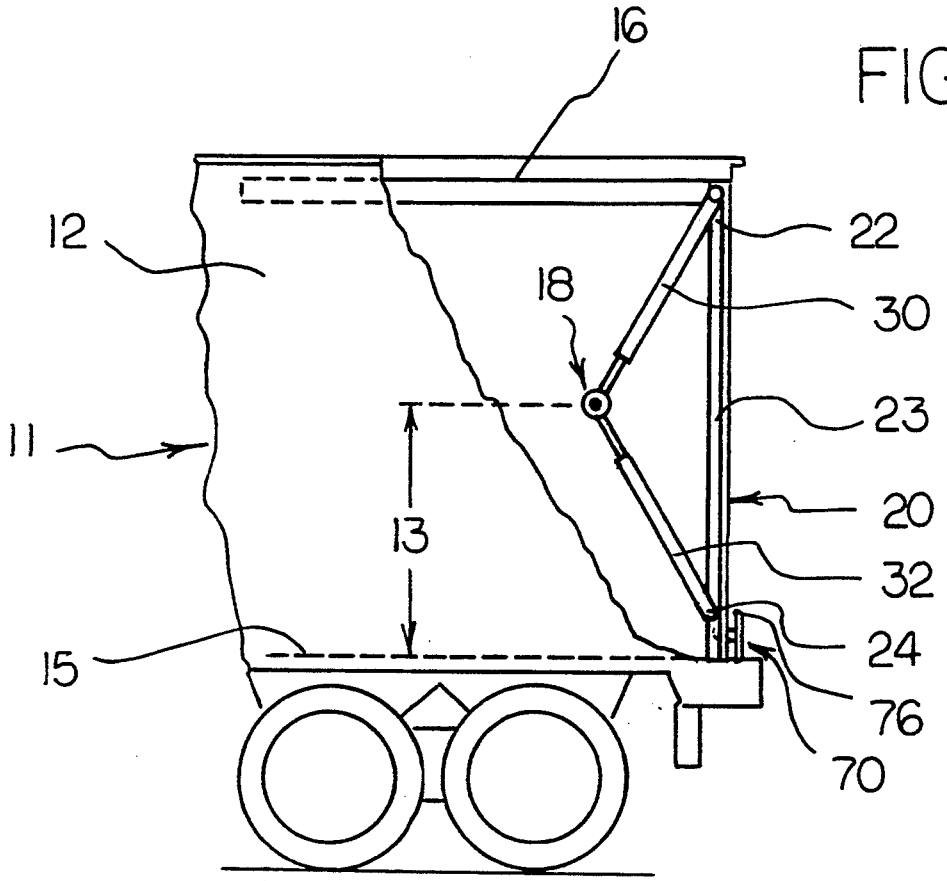
FIG. 3 is a partially broken away side view showing the embodiment of the overhead door apparatus of the invention shown in FIG. 1 installed on a trailer, wherein the overhead door apparatus is closed.
Figure 4:
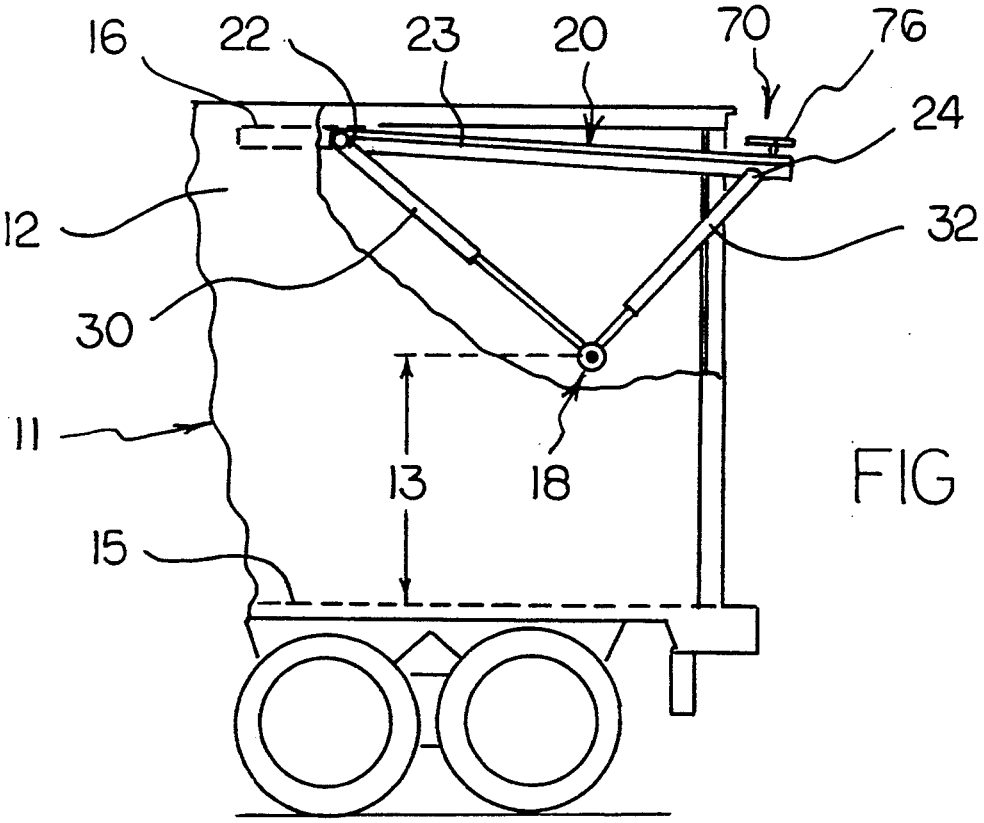
FIG. 4 is a partially broken away side view showing the embodiment of the overhead door apparatus of the invention shown in FIG. 1 installed on a trailer, wherein the overhead door apparatus is completely open.

In use, the overhead door apparatus 10 of the invention begins in the closed position shown in FIG. 3. A handle 76 is grasped by a user, and the door panel assembly 20 is pulled upward. A partially open position of the door panel assembly 20 is shown in FIG. 1. Finally, the door panel assembly 20 is shown in the completely open position in FIG. 4. Pairs of triangles are formed by the pair of the first extensible and retractable assemblies 30, the pair of the second extensible and retractable assemblies 32, and the pair of sides 23 of the door panel assembly 20. As the door panel assembly 20 moves from the closed position to the open position, or vice versa, the locations of the central pivot assemblies 18 on the sidewalls 12 remain fixed, and the top corners 22 of the door panel assembly 20 move along the horizontally oriented guide channel assemblies 16. As a consequence, the interior angles of the triangles change depending upon the degree of opening or closure of the door panel assembly 20. Similarly, as the door panel assembly 20 moves from the closed position to the open position and vice versa, the sides of the triangles defined by the first extensible and retractable assemblies 30 and the second extensible and retractable assemblies 32 lengthen and shorten depending upon the degree of opening or closure of the door panel assembly 20. Of course the sum of the internal angles of the triangles are always equal to 180 degrees, and the lengths of the pair of sides 23 remain constant during all stages of opening and closing of the door panel assembly 20.

More generally, the components of the overhead door apparatus of the invention can be made from inexpensive and durable metal, plastic, and fiberglass materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved overhead door apparatus that is low in cost, relatively simple in design and operation, and which may advantageously be used without including a plurality of articulated panels connected together by hinges. With the invention, a overhead door apparatus is provided which does not include a plurality of rollers associated with each of a plurality of articulated door panels. With the invention, a overhead door apparatus is provided which does not include a vertical stack of hinged door panels and does not include a vertical stack of lateral rollers. With the invention, a overhead door apparatus is provided which employs triangular construction forms. With the invention, a overhead door apparatus is provided which is lightweight. With the invention, a overhead door apparatus is provided which contains components which provide a lifting force to assist a person in lifting the overhead door. With the invention, a overhead door apparatus is provided which employs only one door panel. With the invention, a overhead door apparatus is provided which provides counterbalancing of a single door panel without the use of gears.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved overhead door apparatus for a structure which has a pair of sidewalls spaced from each other by a predetermined distance and which has a floor located between the pair of sidewalls, comprising:

a pair of guide channel assemblies connected to the pair of sidewalls of the structure a predetermined distance from the floor of the structure, a pair of central pivot assemblies connected to the pair of sidewalls of the structure, wherein said central pivot assemblies are located on the pair of sidewalls at locations between said pair of guide channel assemblies and the floor of the structure, a rigid unitary door panel assembly which includes a pair of top corners, a pair of bottom corners, and a pair of sides separating said pair of top corners from said pair of bottom corners, wherein said pair of top corners of said door panel assembly include a pair of roller assemblies adapted to roll along said pair of guide channel assemblies, a pair of first extensible and retractable assemblies connected between said pair of top corners of said door panel assembly and said pair of central pivot assemblies, a pair of first pivot assemblies for pivotally connecting said pair of first extensible and retractable assemblies to said pair of top corners of said door panel assembly, a pair of second extensible and retractable assemblies connected between said pair of bottom corners of said door panel assembly and said pair of central pivot assemblies, and a pair of second pivot assemblies for pivotally connecting said pair of second extensible and retractable assemblies to said pair of bottom corners of said door panel assembly, wherein a side of said pair of door panel sides, a first extensible and retractable assembly of said pair of first extensible and retractable assemblies, and a second extensible and retractable assembly of said pair of second extensible and retractable assemblies form three sides of a triangular structure, and wherein a first pivot assembly of said pair of first pivot assemblies, a second pivot assembly of said pair of second pivot assemblies, and a central pivot assembly of said pair of central pivot assemblies form apexes of the triangular structure.

2. The apparatus described in claim 1 wherein:

said first extensible and retractable assemblies include first hydraulic cylinder assemblies, said second extensible and retractable assemblies include second hydraulic cylinder assemblies, said central pivot assemblies include a first pivot wheel and a second pivot wheel supported by common pivot axles, an end of one of said first extensible and retractable assemblies is connected to said first pivot wheel, and an end of one of said second extensible and retractable assemblies is connected to said second pivot wheel.

3. The apparatus described in claim 1 wherein said first extensible and retractable assemblies and said second extensible and retractable assemblies include internal springs.

4. The apparatus described in claim 1 wherein said guide channel assemblies are connected to the two sidewalls near top portions of the sidewalls.

5. The apparatus described in claim 1 wherein said central pivot assemblies are located on the two sidewalls at locations mid-way between said guide channel assemblies and the floor of the structure.

6. The apparatus described in claim 1 wherein the structure which has the two sidewalls is a trailer.

7. The apparatus described in claim 1 wherein the structure which has the two sidewalls is a truck.

8. The apparatus described in claim 1 wherein said door panel assembly includes:

a frame assembly which includes a four-sided and four-corned peripheral frame portion and a four-legged, X-shaped interior frame portion having four end portions which connect with corner portions of said four-corned frame portion, wherein a triangle is formed by each peripheral side of said peripheral frame portion and two legs of said interior frame portion, and a cover for covering said frame assembly.

9. The apparatus described in claim 8 wherein:

said frame assembly is made of aluminum, and said cover is made of fiberglass.

10. The apparatus described in claim 8, further including:

a pair of transverse frame members connected between a pair of peripheral sides and an X-portion of said interior frame portion.

11. The apparatus described in claim 10 wherein said transverse frame members perpendicularly bisect said pair of said peripheral sides.

12. The apparatus described in claim 1 wherein said door panel assembly further includes a lock assembly for locking said door panel assembly in a closed position.

* * * * *